US008152002B2

(12) United States Patent
Gibert Guasch

(10) Patent No.: US 8,152,002 B2
(45) Date of Patent: Apr. 10, 2012

(54) CONTAINER SUPPORT AND STORAGE PLATE

(75) Inventor: Pere Gibert Guasch, Sant Sadurni d'anoia (ES)

(73) Assignee: Freixenet, S.A., Sant Sadurni d'Andoia (Barcelona) (ES)

( * ) Notice: Subject to any disclaimer, the term of this patent is extended or adjusted under 35 U.S.C. 154(b) by 427 days.

(21) Appl. No.: 12/179,517

(22) Filed: Jul. 24, 2008

(65) Prior Publication Data

US 2009/0026157 A1 Jan. 29, 2009

(30) Foreign Application Priority Data

Jul. 25, 2007 (ES) ..... 200702076

(51) Int. Cl.
*A47F 1/04* (2006.01)

(52) U.S. Cl. ..... 211/59.4

(58) Field of Classification Search ..... 206/486, 206/490, 563, 562, 564, 196, 588, 589, 593, 206/821, 507, 391, 197; 211/59.4, 85.4, 211/74, 72, 73, 184

See application file for complete search history.

(56) References Cited

U.S. PATENT DOCUMENTS

| | | | | | |
|---|---|---|---|---|---|
| 1,759,079 | A * | 5/1930 | Wolf et al. | ..... | 206/487 |
| 2,100,035 | A * | 11/1937 | Merrick | ..... | 211/74 |
| 2,828,008 | A * | 3/1958 | Fryburger | ..... | 206/196 |
| 3,144,343 | A * | 8/1964 | Fritsche | ..... | 426/115 |
| 3,372,812 | A * | 3/1968 | Parcels | ..... | 211/59.4 |
| 3,439,798 | A * | 4/1969 | James | ..... | 206/149 |
| 3,628,671 | A * | 12/1971 | Schweickart | ..... | 211/73 |
| 3,682,351 | A * | 8/1972 | De Putter | ..... | 206/505 |
| 3,802,555 | A * | 4/1974 | Grasty et al. | ..... | 206/572 |
| 4,516,677 | A * | 5/1985 | Rowland et al. | ..... | 206/394 |
| 4,645,079 | A * | 2/1987 | Hill | ..... | 206/563 |
| 5,144,897 | A * | 9/1992 | Avery | ..... | 108/55.3 |
| 5,161,703 | A * | 11/1992 | Patton | ..... | 211/59.4 |
| 5,261,535 | A * | 11/1993 | Light et al. | ..... | 206/391 |
| 5,320,223 | A * | 6/1994 | Allen | ..... | 206/372 |
| 5,335,770 | A * | 8/1994 | Baker et al. | ..... | 206/433 |
| 5,377,855 | A * | 1/1995 | Cook et al. | ..... | 220/4.23 |
| 5,409,560 | A * | 4/1995 | Hammer et al. | ..... | 156/248 |
| 5,647,284 | A * | 7/1997 | Frysinger et al. | ..... | 108/55.1 |
| 6,036,024 | A * | 3/2000 | Seidler | ..... | 206/780 |
| 6,311,842 | B1 * | 11/2001 | Minerich et al. | ..... | 206/562 |
| 6,615,996 | B1 | 9/2003 | Ivey | | |
| 6,685,036 | B2 * | 2/2004 | de Jenlis et al. | ..... | 211/59.4 |
| 6,935,505 | B1 * | 8/2005 | Nash et al. | ..... | 206/562 |
| 7,237,684 | B2 * | 7/2007 | Kanachowski | ..... | 211/59.4 |
| 7,556,152 | B2 * | 7/2009 | Lechelle | ..... | 206/581 |
| 2004/0000504 | A1 * | 1/2004 | Wang | ..... | 206/725 |
| 2004/0195191 | A1 * | 10/2004 | Carlin et al. | ..... | 211/49.1 |
| 2004/0238398 | A1 * | 12/2004 | Wilson | ..... | 206/564 |
| 2005/0016942 | A1 * | 1/2005 | Lobe | ..... | 211/59.4 |
| 2010/0065458 | A1 * | 3/2010 | Myers et al. | ..... | 206/459.1 |

FOREIGN PATENT DOCUMENTS

| | | |
|---|---|---|
| DE | 7909669 | 6/1988 |
| DE | 8711170 | 9/1988 |
| EP | 0020227 | 12/1980 |
| EP | 0324699 | 7/1989 |
| FR | 2350273 | 12/1977 |
| FR | 2622420 | 5/1989 |
| FR | 2755098 | 4/1998 |

(Continued)

*Primary Examiner* — Jennifer E. Novosad
(74) *Attorney, Agent, or Firm* — Leason Ellis LLP

(57) ABSTRACT

Container support plate and the use thereof for the storage of containers by stacking said plates.

6 Claims, 8 Drawing Sheets

FOREIGN PATENT DOCUMENTS * cited by examiner

| | | |
|---|---|---|
| GB | 666791 | 2/1952 |
| GB | 773736 | 5/1957 |
| WO | 03/020592 | 3/2003 |

CONTAINER SUPPORT AND STORAGE PLATE

CROSS-REFERENCE TO RELATED APPLICATIONS

This application claims priority under 35 U.S.C. §119 to Spanish patent application Serial No. 200702076, filed Jul. 25, 2007, the entire content of which is hereby incorporated by reference.

The present invention relates to a container support plate and the use thereof for container storage by stacking said plates.

The container support and storage plate according to the present invention is particularly suitable for stacking bottles of sparkling wine, although it is applicable to any process that involves a storage phase for containers that comprise a round body, preferably substantially cylindrical, and for any type of bottle in particular.

Making sparkling wine comprises a drawing stage, in which the bottles are filled with wine, fermenting agents and sugars. Stacking occurs after this operation, when the bottles are stored horizontally to produce the second fermentation.

In recent years, the use of moulded trays, designed to support bottles horizontally, and the use thereof to store bottles by stacking them vertically has been introduced in the industry.

The system of stacking by using trays and platforms is advantageous as regards the method of stacking bottles in containers, since it makes it possible to work with blocks of bottles (making it easier to handle a relatively small unit of bottles), to automate the process and to improve occupation of volume in wine cellars.

These moulded trays consist of a laminar body provided with a plurality of cavities suitable for accommodating bottles arranged horizontally. Accordingly, each cavity has a wider zone, corresponding to the base and body of the bottle, and an opposite narrower zone, corresponding to the neck of the bottle.

The various models of moulded trays for bottle storage are differentiated basically by the arrangement of the cavities that accommodate the bottles, which ultimately determines how effectively the surface area of the tray is used, the storage volume and the stability when stacked on platforms.

An example of this kind of plate and storage units is WO 03/020592A1. Said document discloses a plate for making storage units of bottles arranged in layers, the axes of revolution of the bottles of each layer arranged coplanarly and horizontally. The bottles are sustained by cavities on the plate, so that each plate of the unit fully separates adjoining layers, so that there is no contact between bottles.

However, a problem that arises with these trays is associated with the need to clean them. In fact, during fermentation, pressure increases inside the bottle causing a number of bottles to burst and pour out part of the sugary content thereof. Said sugars form a sticky film that causes the bottles to adhere in the cavities, making the de-stacking process difficult. The tray must therefore be cleaned, which, because of the cavities, is a costly operation that is complex to automate.

In this context, the present invention proposes a plate that performs the same function as the moulded trays but does not have the above-mentioned drawbacks of soiling and cleaning, and is simpler to manufacture. Accordingly, the present invention relates to a support and storage plate for containers with round bodies that is substantially planar and has holes to support the containers by the perimeter of said holes. More in particular, the present invention discloses a plate for storage units of containers with round bodies, the storage unit comprising at least two layers of containers with the axes of revolution of the round bodies coplanarly arranged, and at least a plate arranged between the planes which are defined by the axes of revolution of the bottles of said two layers, characterised in that it has holes for holding containers by contact between the perimeter of the holes with the surface of said round bodies, while allowing the contact between containers of adjoining layers.

The present invention also relates to the container storage unit by vertical stacking of at least two plates, the holes of which are occupied by containers, and to the vertical stacking of platforms loaded with plates.

Preferably, the containers of adjoining layers of the storage unit will be in contact between them.

The simple design of the planar perforated plates of the present invention has a number of advantages compared with the three-dimensional moulded trays of the state of the art:

- they are easier to manufacture;
- they are less voluminous, and are therefore easier to handle in production. In addition they can be stacked for storage, thereby occupying less space;
- they are easier to maintain and clean, especially when one of the supported containers or bottles breaks;
- contact between the bottles and the planar plate is linear, and not areal as with the moulded trays, so that the bottles do not stick excessively, making it easier to release the bottle and minimising possible breakages caused by adherence of the bottle to the support.

Moreover, in preferred embodiments, it is possible to provide a plate so that it allows the contact between containers located on adjoining plates, so that, under normal conditions, the containers of a lower layer sustain the containers of the upper adjoining layer, the perimeter of the holes acting as a centering element, so that the perimeter of the holes acts as a holder for the bottles of the perimeter of the storage unit and, when a bottle of the storage unit is broken, for the bottles adjoining a broken bottle. This allows a reduction of the thickness of the plates.

The present invention proposes a support and storage plate for containers with round bodies that is substantially planar and has holes to support the container by the perimeter of said holes.

Applying the geometric tangent-secant principle, which is explained below, the inventors have designed a planar perforated plate of a preferred configuration that allows maximum use to be made of the space occupied by the plates loaded with bottles or other containers when they are stacked vertically for storage.

In a preferred embodiment of the present invention, the planar perforated plate is designed to support and store containers with round and substantially cylindrical bodies of radius R and height H. Accordingly, the plate comprises holes of rectangular section of approximately $R\sqrt{2}$ in width by H in length to support, by the perimeter of said holes, the containers referred to above arranged therein. Thus, because contact between the containers and the plate is linear, the containers do not adhere excessively to the plate, making it easier to release the bottles when the plate is emptied, and in addition possible breakage of containers that have stuck is avoided.

In another embodiment of the present invention, the planar perforated plate is designed to support and store bottles that comprise a substantially cylindrical body and a neck, and the plate therefore comprises holes of rectangular section at one end, in contact with the cylindrical portion, and of parabolic section at the other end, in contact with the conical portion of the bottle.

The planar perforated plate preferably has various holes identical to each other to support the containers or bottles in the same plane.

More preferably and in order to make more efficient use of the surface area of the planar plate, the holes are arranged in a row at a distance such that the containers or bottles occupying them are in lateral contact.

Even more preferably, the holes in the planar plate are arranged in a number of parallel rows. Preferably, the planar plate has at least two parallel rows of holes so that the bottles in the first two rows of holes face each other, inserting the necks of the bottles in the first row in the gaps between the necks of the bottles in the second row.

More preferably, the planar plate has at least four parallel rows of holes such that the bases of the bottles in the third row face, and at the same time are displaced from, the bases of the bottles in the second row; and the bottles in the fourth row face the bottles in the third row, inserting the necks of the bottles in the third row in the gaps between the necks of the bottles in the fourth row.

These preferred embodiments allow an improved degree of bottle packing to be achieved.

Even more preferably, the planar plate has four rows with 12, 11, 12 and 11 holes respectively, so that the bottles in the first row of holes have their necks inserted between the necks of the bottles in the second row of 11 holes. The next two rows are placed identically to the first two, so that the bases of the bottles in the third row with 12 holes face, and at the same time are displaced from, the bottles in the second row.

Optionally, the planar perforated plates may have stiffening reinforcements to minimise deformation of the plate by the action of the weight of the containers or of the plate itself. Advantageously, the stiffening reinforcements comprise at least one doubling of the plate lamina although other stiffening means could be used.

The plate of the present invention can also have centering stubs arranged between holes for contacting the necks of the bottles. It can also have recesses at the outer perimeter for helping the palletisation of the storage unit.

In the same way as the known moulded trays, the planar perforated plates according to the present invention may be stacked vertically for bottle or container storage.

The invention therefore also relates to the storage unit for containers with round bodies by the vertical stacking of at least two plates according to the present invention, the holes of which are occupied by said containers.

Preferably, the present invention relates to the storage unit for containers with round, and substantially cylindrical bodies.

More preferably, the storage unit arranges the containers with round, and substantially cylindrical bodies as a quincunx, in other words occupying the central gap defined by the containers of the immediately contiguous plate.

Even more preferably, in the storage unit each plate is inverted or turned through 180° in relation to the one that precedes it on the platform. Thus, highly compact packing that arranges the bottles as a quincunx is achieved using a single plate design.

Additionally, the storage unit may comprise the vertical stacking of at least two platforms loaded with groups of plates. Thus, highly compact packing is achieved, allowing the storage space to be used to the maximum while conferring great mechanical rigidity and stability on the stack.

Although the container support and storage plate according to the present invention can be applied to any process that involves a storage phase of round-bodied containers in general, it is used in particular for stacking bottles of sparkling wine.

For better interpretation of the subject matter of the present invention the accompanying drawings of a preferred embodiment of the present invention are given as an explanatory but not limiting example.

FIG. 1 shows diagrammatically the geometric tangent-secant principle that led to the design of a preferred planar perforated plate, the configuration of which allows the space to be used to the maximum.

Four tangent circumferences of radius R are considered, with the centres thereof aligned at a first level 11 with distances between centres of 2R and three tangent circumferences of radius R with the centres thereof aligned at a second level 12 with distances between centres also of 2R. To optimise the space, the circumferences of radius R of the second level 12 are arranged occupying the central gap defined by the circumferences of the first level 11, such that the distance D between the lines of the centres of the circumferences of the first and second level correspond to 2R sin 60°. This arrangement defines a straight line L tangent to the circumferences of the first level 11 and secant to the circumferences of the second level 12.

Figure 1:
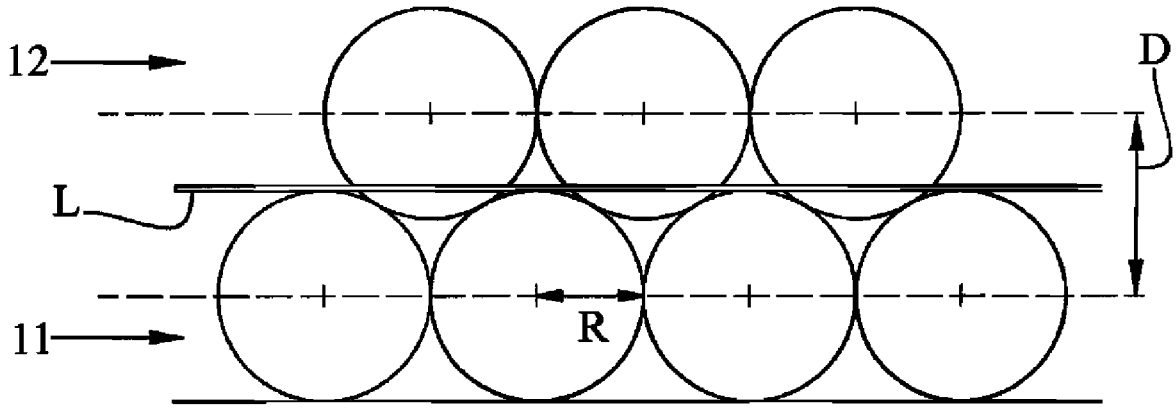
FIG. 1 shows diagrammatically the geometric tangent-secant principle with circumferences of radius R, incorporating various calculation parameters.
Figure 2:
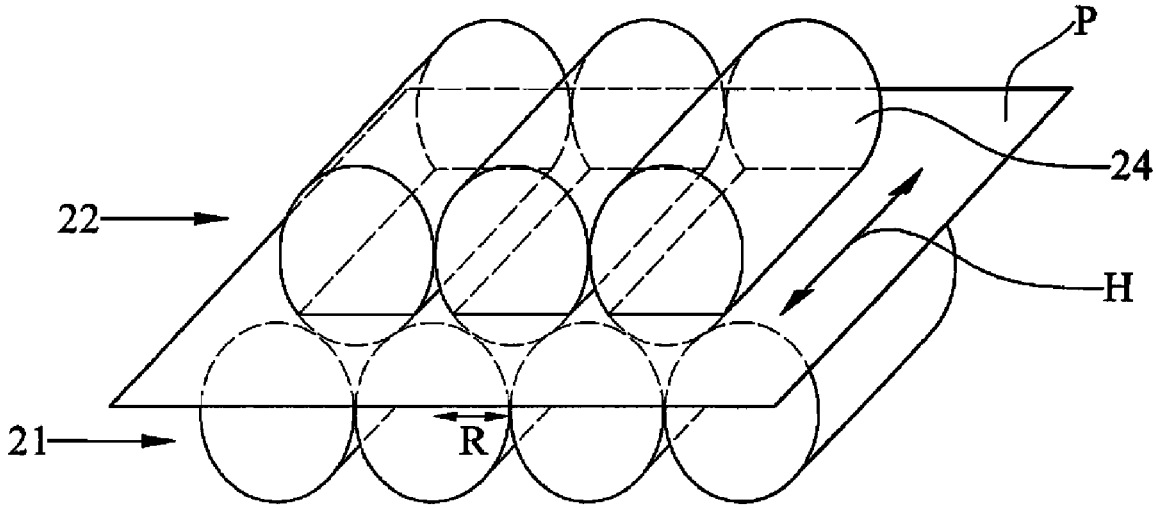
FIG. 2 shows diagrammatically the geometric tangent-secant principle with cylinders of radius R and height H, incorporating various calculation parameters.

In FIG. 2, the above geometric principle is extrapolated to the three-dimensional space. Considering cylinders of radius R and height H, a plane P is defined tangent to the cylinders of the first level 21 and secant to the cylinders of the second level 22 with rectangular intersector sections 24 of $R\sqrt{2}$ by H.

Applying the above geometric principle to the round surfaces of the sparkling wine bottles, a plane is defined tangent to the bottles in the first level 31 and secant to the bottles in the second level 32 with intersector sections 34 in the form of closed curves of rectangular appearance at one end, in contact with the cylindrical portion, and parabolic appearance at the other end, in contact with the conical portion of the bottle.

Figure 3:
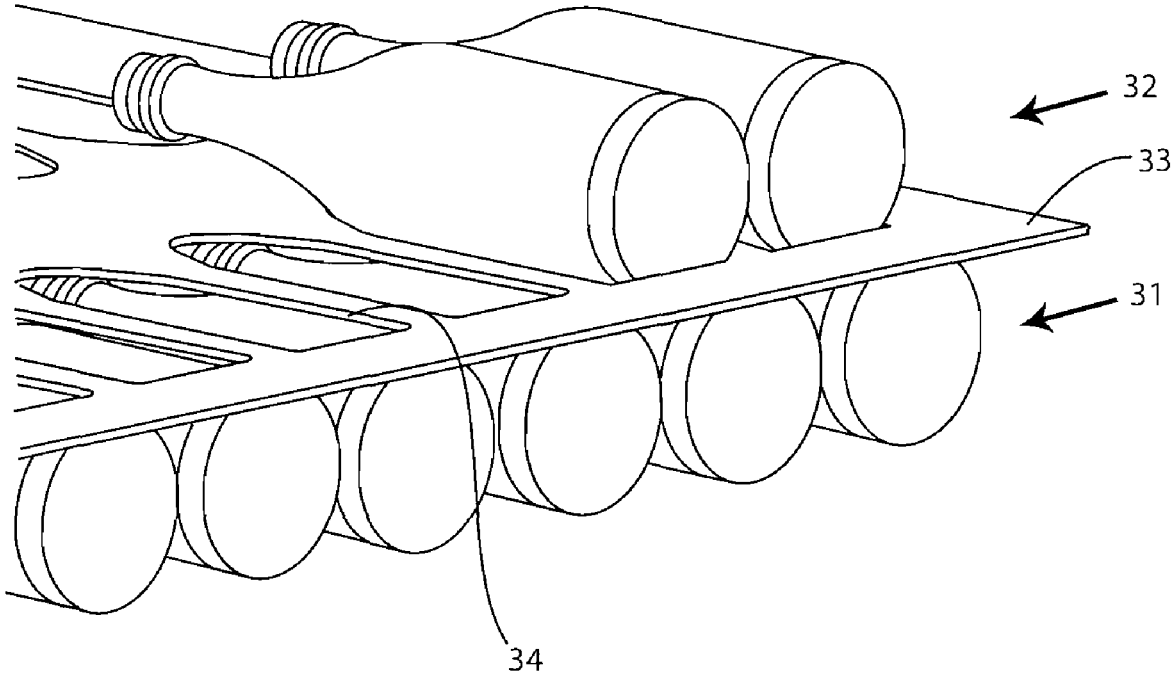
FIG. 3 shows the perspective view of the vertical stacking system of planar perforated plates according to the geometric tangent-secant principle with the bottles being arranged as a quincunx.

When the plane P is materialised, the holes of which are defined by the intersector section generated by the bottle, the planar perforated plate 33 for supporting sparkling wine bottles shown in FIG. 3 is obtained.

The vertical stacking of planar perforated plates according to the geometric tangent-secant principle arranges the bottles as a quincunx, in other words, the bottles in one level occupy the central gaps defined by the bottles in the contiguous level.

Figure 4:
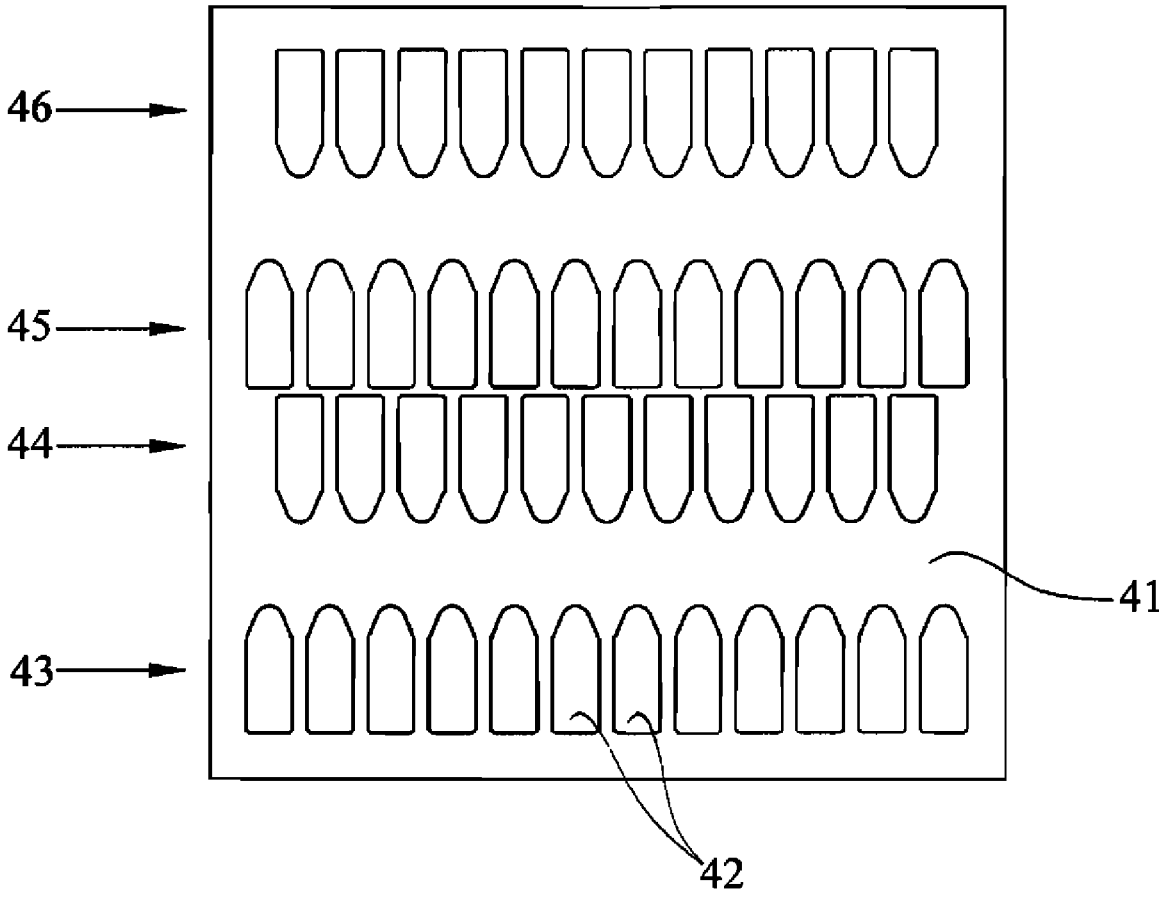
FIG. 4 shows the plan view of a preferred embodiment of the planar perforated plate according to the present invention to support conventional sparkling wine bottles.

FIG. 4 shows a plan view of an embodiment of the planar perforated plate 41 according to the present invention designed to support and store sparkling wine bottles of standard format horizontally.

It is a planar perforated plate manufactured from a substantially planar laminar material defining a set of holes 42 identical to each other with a section that is rectangular at one end and parabolic at the other end, which allows standard format sparkling wine bottles to be supported horizontally by the perimeter of said holes.

The planar perforated plate 41 of the present preferred embodiment has four parallel rows 43, 44, 45, 46 each with 12, 11, 12, 11 identical holes respectively which allow the sparkling wine bottles to be arranged in the same plane and in lateral contact.

Figure 5:
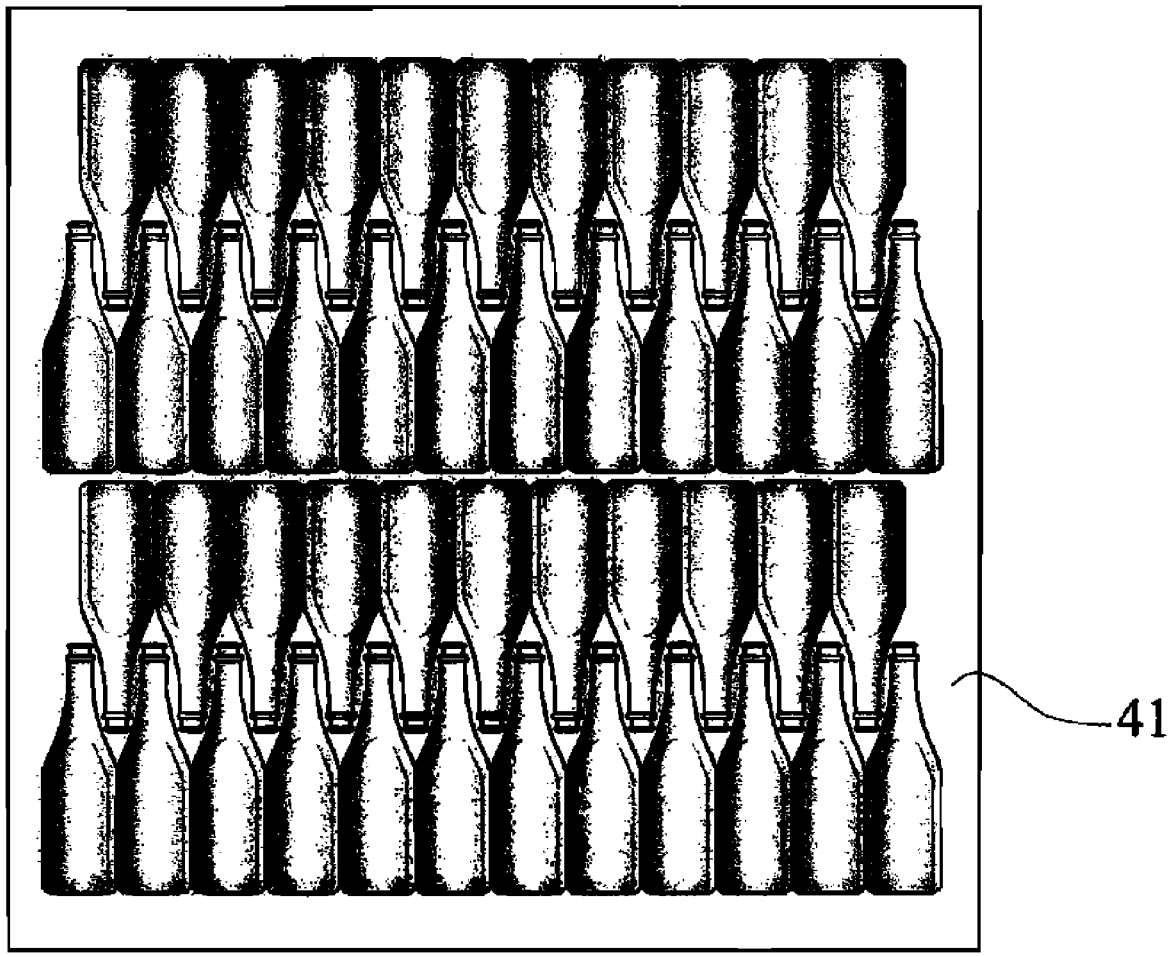
FIG. 5 shows the plan view of the planar perforated plate of FIG. 4 loaded with bottles.

FIG. 5 shows a plan view of the planar perforated plate of FIG. 4 41 loaded with bottles. The twelve bottles in the first row of holes 43 face the bottles in the second row 44, which has eleven holes, the necks of the bottles in the first row 43 being inserted in the gaps between the necks of the bottles in the second row 44. The bottles in the third 45 and fourth row 46 of holes are placed in exactly the same way as those in the first two rows, so that the bases of the bottles in the third row 45 face, and at the same time are displaced from, the bases of the bottles in the second row 44; and the bottles in the fourth row 46 face the bottles in the third row 45, the necks of the bottles in the third row 45 being inserted in the gaps between the necks of the bottles in the fourth row 46.

Figure 6:
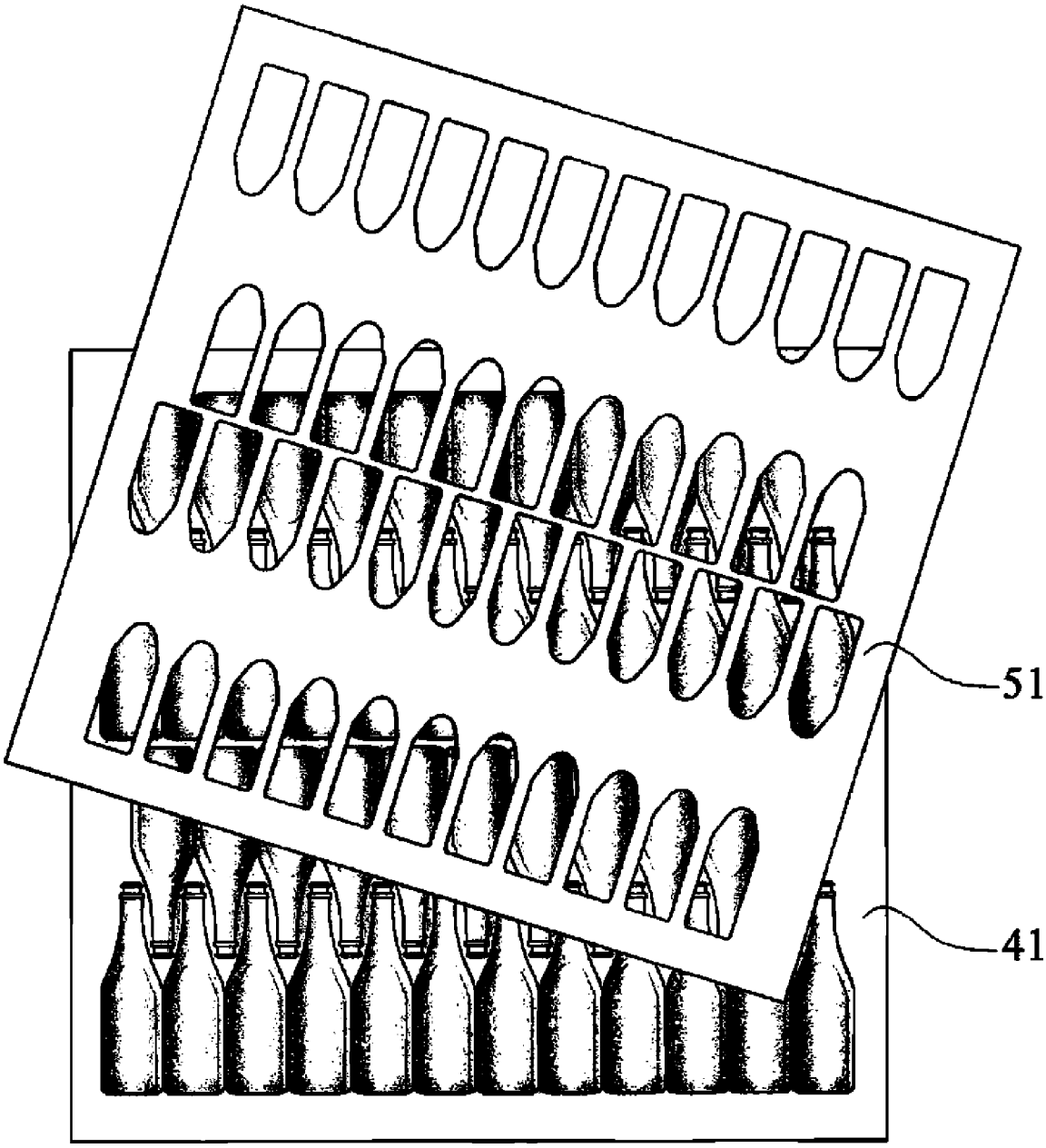
FIG. 6 shows the plan view of the vertical stacking system of the planar perforated plates of FIG. 4 for bottle storage.

FIG. 6 shows the plan view of a vertical stacking unit of planar perforated plates 41 according to FIG. 4 for storing bottles horizontally.

Figure 7:
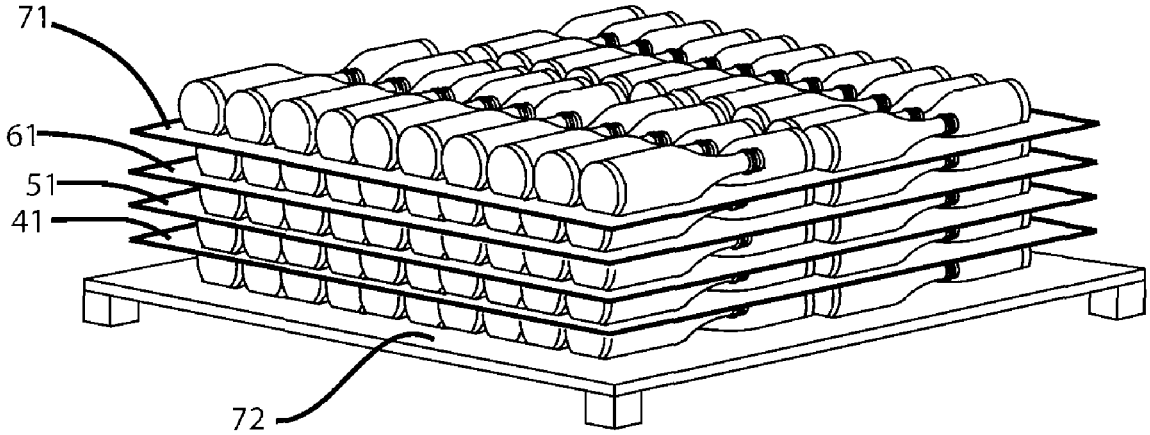
FIG. 7 shows the perspective view of the bottle storage unit by vertical stacking of the planar perforated plates of FIG. 4 on a platform.

Thus, as shown in FIG. 6, the next plate 51 need only be placed inverted or turned through 180° in relation to the plate that precedes it on the platform 41. If this pattern of planar perforated plates 41, 51, 61 is repeated, with alternate turns through 180° between contiguous levels, the storage unit for sparkling wine bottles of FIG. 7 is obtained in which the bottles are arranged as a quincunx by vertical stacking of planar perforated plates loaded with bottles on platforms 72. This palletisation system is characterised in that it produces highly compact packing, which allows maximum use to be made of the storage space while conferring great mechanical rigidity and stability on the stack.

Figure 8:
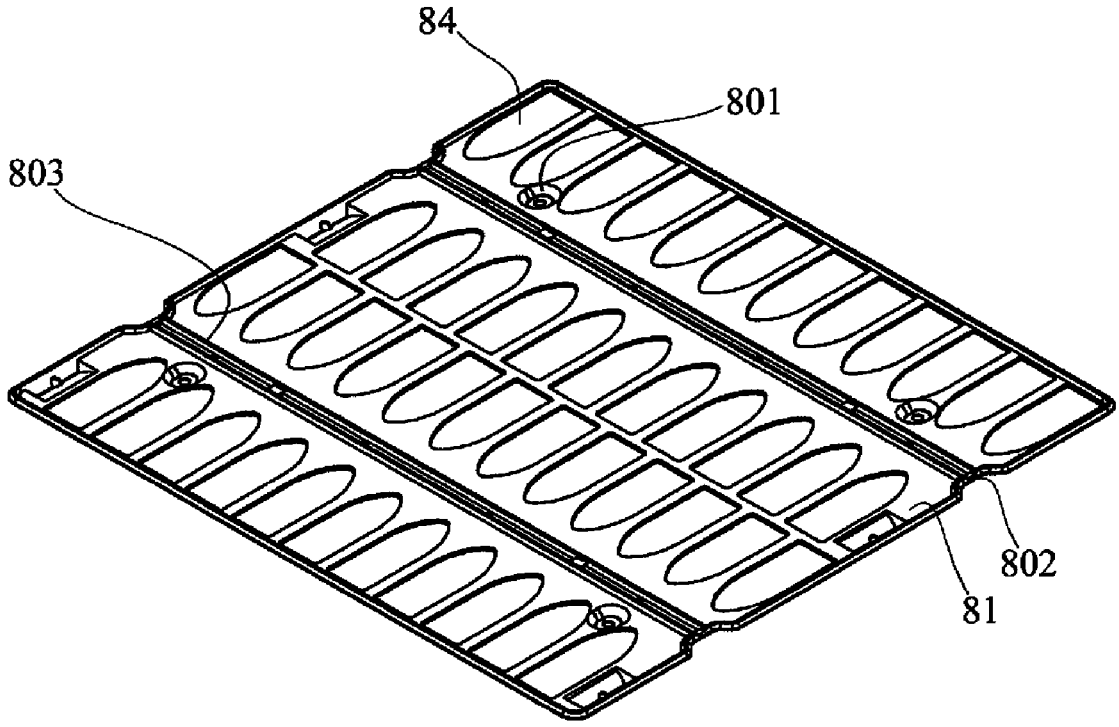
FIG. 8 shows a perspective view of a second embodiment of a plate according to the present invention.

FIG. 8 shows a second embodiment of plate—81—according to the present invention. Said embodiment is similar to the previous one, having holes—801—for receiving bottles. The second shown embodiment also presents stubs—802—between holes for centering the bottles by contact between the stub—802—and the necks of the bottles. It also presents an outer perimeter with recesses—802—which allows the passage of palletisation elements without increasing the global dimensions of the storage unit. Moreover, the plate presents rigidisation doublings—803—of the sheet of the plate which allow for a plate with less thickness.

Although the planar perforated plate according to the present invention has been described particularly for supporting and storing sparkling wine bottles in the fermentation stage, it can also be applied to any process involving a storage phase of bottles or other containers with round bodies, preferably substantially cylindrical.

Although the invention has been described in relation to examples of preferred embodiments, these should not be regarded as limiting the invention, which is defined by the widest interpretation of the following Claims.

The invention claimed is:

1. A storage unit for containers having round bodies, the storage unit comprising:

at least two layers of containers with axes of the rounded bodies of each layer of containers arranged coplanarly; and at least a first plate arranged between the planes defined by the axes of revolution of the containers of said two layers, the first plate having a plate body that has holes for holding the containers due to contact between a perimeter of one hole with a surface of the round body of one container, the holes being arranged so as to permit two layers of containers to be stored by arranging the plate between planes which are defined by axes of revolution of the containers of the two layers, while allowing the contact between containers of adjoining layers, wherein the containers of one layer are offset laterally from the containers of the other layer, the containers of one layer being supported along one face of the plate body by being received at least partially within the holes.

2. The storage unit, according to claim 1, wherein the containers of adjoining layers are in contact between the layers.

3. The storage unit according to claim 1, wherein the containers comprise substantially cylindrical round bodies.

4. The storage unit according to claim 1, wherein the containers are arranged as a quincunx.

5. The storage unit according to claim 1, wherein the containers are sparkling wine bottles.

6. A storage unit for containers having round bodies, the storage unit comprising:

at least two layers of containers with axes of the rounded bodies of each layer of containers arranged coplanarly; and at least a first plate arranged between the planes defined by the axes of revolution of the containers of said two layers, the first plate having a plate body that has holes for holding the containers due to contact between a perimeter of one hole with a surface of the round body of one container, the holes being arranged so as to permit two layers of containers to be stored by arranging the plate between planes which are defined by axes of revolution of the containers of the two layers, while allowing the contact between containers of adjoining layers, wherein the containers of one layer are offset laterally from the containers of the other layer, the containers of one layer being supported by intimately contacting and seating against and upon the containers located in an underlying layer as a result of a portion of the containers passing through respective holes of the first plate.

* * * * *